US005782998A

United States Patent [19]

Ushigami et al.

[11] Patent Number: 5,782,998

[45] Date of Patent: Jul. 21, 1998

[54] GRAIN ORIENTED ELECTRICAL STEEL SHEET HAVING SPECULAR SURFACE

[75] Inventors: Yoshiyuki Ushigami; Takeo Nagashima; Shuichi Yamazaki; Hiroyasu Fujii; Yozo Suga; Tadashi Nakayama, all of Futtsu; Katsuro Kuroki, Kitakyushu; Yosuke Kurosaki, Himeji, all of Japan

[73] Assignee: Nippon Steel Corporation, Tokyo, Japan

[21] Appl. No.: 175,430

[22] PCT Filed: Feb. 4, 1993

[86] PCT No.: PCT/JP93/00136

§ 371 Date: Jan. 7, 1994

§ 102(e) Date: Jan. 7, 1994

[87] PCT Pub. No.: WO93/23577

PCT Pub. Date: Nov. 25, 1993

[30] Foreign Application Priority Data

May 8, 1992 [JP] Japan ..... 4-116453
Aug. 5, 1992 [JP] Japan ..... 4-209222

[51] Int. Cl.[6] ..... C21D 8/12

[52] U.S. Cl. ..... 148/113; 148/111

[58] Field of Search ..... 148/111, 113

[56] References Cited

U.S. PATENT DOCUMENTS

| | | | |
|---|---|---|---|
| 3,207,639 | 9/1965 | Mobius | 148/113 |
| 3,976,518 | 8/1976 | Kuroki | 148/113 |
| 4,255,205 | 3/1981 | Morito et al. | 148/113 |
| 4,473,416 | 9/1984 | Kawamo et al. | 148/111 |
| 4,929,286 | 5/1990 | Komatsu et al. | 148/111 |
| 5,203,928 | 4/1993 | Inokuti et al. | 148/113 |

FOREIGN PATENT DOCUMENTS

| | | | |
|---|---|---|---|
| 0 484 109 | 5/1992 | European Pat. Off. . | |
| 2445377 | 7/1980 | France . | |
| A60-39123 | 2/1985 | Japan . | |
| 64-79381 | 3/1989 | Japan | 148/113 |
| 2-77525 | 3/1990 | Japan . | |
| 2-107722 | 4/1990 | Japan | 148/113 |
| A2-232399 | 9/1990 | Japan . | |

OTHER PUBLICATIONS

Supplementary European Search Report 93 90 3307, Feb. 15, 1995.

*Primary Examiner*—Sikyin Ip
*Attorney, Agent, or Firm*—Kenyon & Kenyon

[57] ABSTRACT

In order to provide a very low iron loss, it is necessary to render the surface of a steel sheet smooth (specular). In the present invention, this is effected in a finish annealing furnace to simultaneously attain a high magnetic flux density and a specular surface. Specifically, after the completion of decarburization annealing, a steel material is pickled to remove an oxide layer present on the surface of the steel sheet, coated with an annealing separator comprising a substance nonreactive or less reactive with $SiO_2$ and then subjected to finish annealing to provide a grain oriented electrical steel sheet having a specular surface. Magnetic domain division and tension coating of the steel sheet can provide a low iron loss value. In the finish annealing, since no time is required for dehydration, the annealing time can be shortened.

13 Claims, 5 Drawing Sheets

GRAIN ORIENTED ELECTRICAL STEEL SHEET HAVING SPECULAR SURFACE

TECHNICAL FIELD

The present invention relates to a process for producing a unidirectionally grain oriented silicon steel sheet that is utilized mainly as an iron core of transformers and other electrical equipment. In particular, the present invention aims at an improvement in the iron loss property through effective finishing of the surface of a unidirectionally grain oriented silicon steel sheet.

BACKGROUND ART

Unidirectionally grain oriented silicon steel sheets are used in magnetic iron core in many types of electrical equipment. The unidirectionally grain oriented silicon steel sheets are steel sheets having an Si content of 0.8 to 4.8% and, in the form of a product, a highly integrated {110}<001> grain orientation.

They are required to have a high magnetic flux density (a value represented by a B8 value) and a low iron loss (a value represented by a $W_{17/50}$ value) as magnetic properties. Particularly, in recent years, there is an ever-increasing demand for a reduction in the power loss from the viewpoint of energy saving.

In order to comply with this demand, a technique for dividing magnetic domains has been developed as means for reducing the iron loss of unidirectionally grain oriented silicon steel sheets.

In the case of laminated cores, for example, Japanese Unexamined Patent Publication (Kokai) No. 58-26405 discloses a method of domain refinement wherein a steel sheet after finish annealing is irradiated with a laser beam to give a small local strain to the steel sheet, thereby dividing magnetic domains to reduce the iron loss. On the other hand, in the case of wound iron cores, for example, Japanese Unexamined Patent Publication (Kokai) No. 62-8617 discloses a method which enables the disappearance of the effect of division of magnetic domains to be prevented even when strain release annealing (stress release annealing) is effected after the steel sheet is fabricated into an iron core. The iron loss has been significantly reduced through division of magnetic domains by the above-described technical means.

However, observation of the migration of these magnetic domains has revealed that some magnetic domains do not migrate, and it has been found that, in addition to the division of magnetic domains, the elimination of the pinning effect, which inhibits the migration of the magnetic domains and is derived from a glass film present on the surface of the steel sheet, is important to a further reduction in the iron loss value of the unidirectionally grain oriented silicon steel sheet.

For this purpose, it is useful to prevent the formation of a glass film on the surface of the steel sheet which inhibits migration of the magnetic domain. For example, U.S. Pat. No. 3,785,882 discloses a method wherein a coarse high-purity alumina is used as an annealing separator to prevent the formation of a glass film. In this method, however, inclusions just under the surface cannot be eliminated, so that the improvement in the iron loss is 2% at the highest in terms of $W_{15/60}$.

Further, an enhancement in the orientation integration of the material is useful for improving the iron loss. In this connection, Taguchi and Sakakura (Japanese Examined Patent Publication (Kokoku) No. 40-15644), Komatsu et al. (Japanese Examined Patent Publication (Kokoku) No. 62-45285), etc. disclose methods wherein a nitride of Al is used as an inhibitor. When the method disclosed in U.S. Pat. No. 3,785,882 wherein alumina is used as the annealing separator is applied to these methods wherein a nitride of Al is used as the inhibitor, the secondary recrystallization becomes so unstable that it is impossible to attain an improvement in the iron loss on a commercial scale.

On the other hand, in order to regulate the inclusion just under the surface and, at the same time, to attain a specular surface, for example, Japanese Unexamined Patent Publication (Kokai) No. 64-83620 discloses a method wherein chemical polishing or electropolishing is effected after the completion of finish annealing. Although chemical polishing, electropolishing and other polishing are feasible for working of a small amount of a sample material on a laboratory level, the practice of these methods on a commercial scale has large problems of the control of concentration of chemicals, control of temperature, provision of pollution control facilities, etc., so that these methods have not been put to practical use.

DISCLOSURE OF THE INVENTION

An object of the present invention is to solve, based on the method for the prevention of a glass film (see for example, U.S. Pat. No. 3,785,882), problems of (1) unstable secondary recrystallization of high magnetic flux density materials using a nitride of Al as an inhibitor in connection with Taguchi and Sakakura (Japanese Examined Patent Publication (Kokoku) No. 40-15644), Komatsu et al. (Japanese Examined Patent Publication (Kokoku) No. 62-45285), etc. and (2) the presence of inclusions just under the surface of the steel sheet.

The present inventors have conducted an investigation on the cause of unstable secondary recrystallization of high magnetic flux density materials using a nitride of Al as an inhibitor with respect to the problem (1) in connection with Taguchi and Sakakura (Japanese Examined Patent Publication (Kokoku) No. 40-15644) and Komatsu et al. (Japanese Examined Patent Publication (Kokoku) No. 62-45285). As a result, they have found that, when the formation of a glass film is prevented, the inhibitor is rapidly weakened during finish annealing, which is causative of the unstable secondary recrystallization. This is because the absence of a glass film causes nitrogen in a solid solution form to easily come out of the system. Accordingly, the present inventors have made various studies on means for inhibiting denitriding and, as a result, have found that the formation of a silica film serving as a barrier to nitrogen or the enrichment of a surface segregation element on the surface of the steel sheet are useful for this purpose.

Further, they have made studies on the problem (2), that is, the regulation of inclusions just under the surface and, as a result, have found that an oxide layer formed in the step of decarburization annealing has a great influence on the inclusions. As a result of various studies on the method for rendering the inclusions absent, they have found the removal of the oxide layer on the surface of the steel sheet as decarburized is very effective and can contribute to a significant improvement in the iron loss.

BEST MODE FOR CARRYING OUT THE INVENTION

The best mode for carrying out the invention will now be described.

The present inventors have prepared two types of decarburized samples (A/B) having a sheet thickness of 0.23 mm and different from each other in the inhibitor. Sample A is a steel sheet sample described in Japanese Examined Patent Publication (Kokoku) No. 30-3651 wherein MnS is used as a main inhibitor, and sample B is a steel sheet sample described in Japanese Unexamined Patent Publication (Kokai) No. 62-45285 wherein a nitride of Al (Al, Si)N is used as a main inhibitor.

Part of the samples, as such, were laminated using alumina as an annealing separator. On the other hand, other part of the samples were pickled to remove the oxide layer formed in the decarburization annealing and then laminated using alumina as an annealing separator.

These laminated samples were subjected to finish annealing in two types of annealing cycles (S1/S2). In S1, annealing was effected in a hydrogen atmosphere having a dew point of −40° C. or below. On the other hand, in S2, annealing was effected in a mixed gas comprising 75% of $N_2$ and 25% of $H_2$ in such a manner that, in order to form a silica film on the surface of the steel sheet, the samples was heated to 800° C. at a dew point of 10° C. and then to 1,200° C. at a temperature rise rate of 15° C./hr. Thereafter, the samples were annealed in a $H_2$ gas for 20 hr to effect purification with respect to S, N, etc.

The products thus produced were subjected to a tension coating treatment, a magnetic domain refinement treatment with laser beam irradiation, and magnetic properties were measured.

Figure 1:
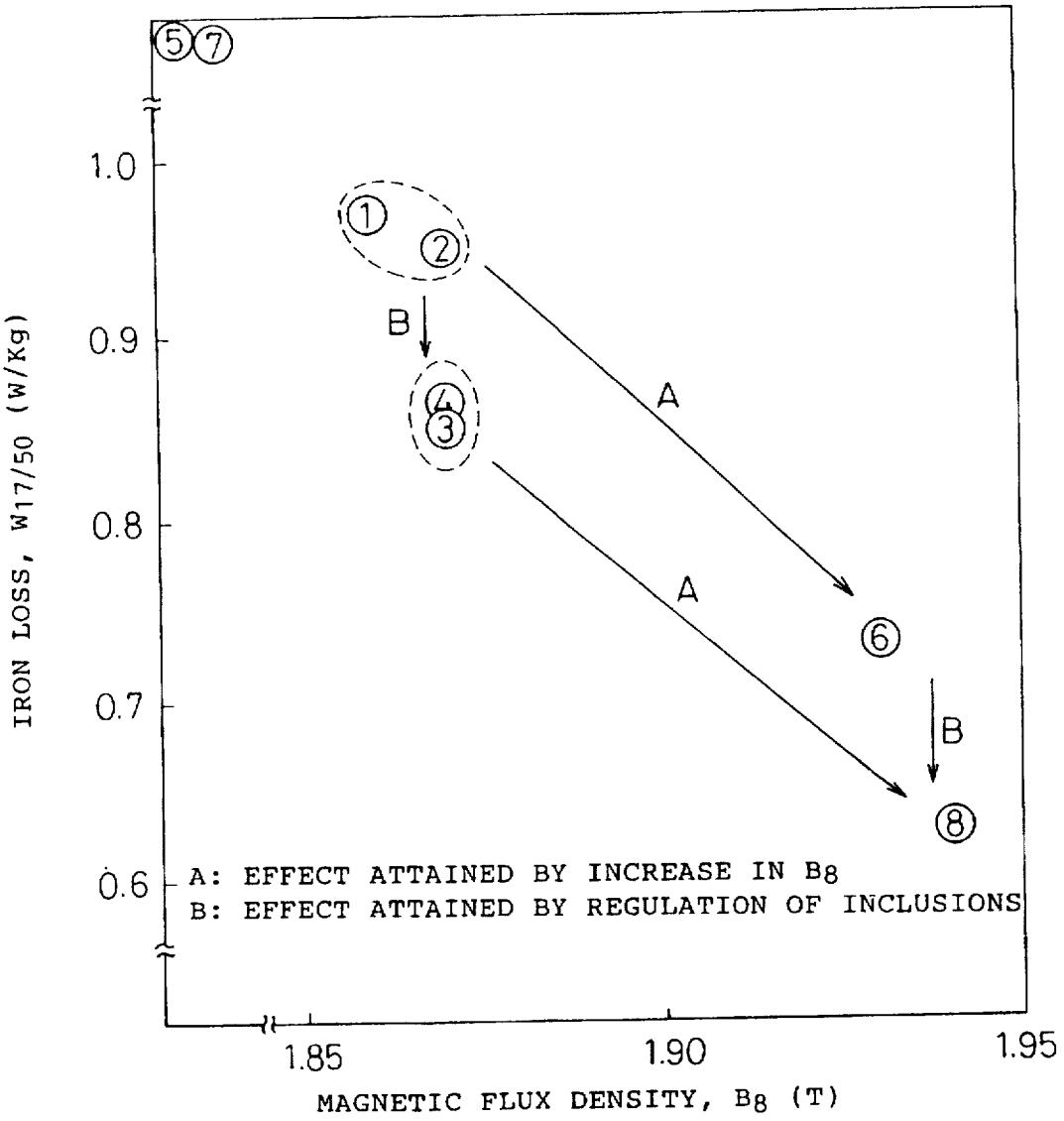
FIG. 1 is a diagram showing the relationship between magnetic flux density B8 and the iron loss $W_{17/50}$ of the products produced under various conditions.

The results are provided in Table 1 and FIG. 1.

TABLE 1

| | Decarburized Sheet | | Finish | Magnetic Properties (average value) | |
|---|---|---|---|---|---|
| No. | Sample | Pickling | Annealing | B8(T) | $W_{17/50}$(W/kg) |
| ① | A | Not done | S1 | 1.86 | 0.97 |
| ② | | | S2 | 1.87 | 0.95 |
| ③ | A | Done | S1 | 1.87 | 0.85 |
| ④ | | | S2 | 1.87 | 0.86 |
| ⑤ | B | Not done | S1 | 1.65* | >1.5 |
| ⑥ | | | S2 | 1.93 | 0.73 |
| ⑦ | B | Done | S1 | 1.68* | >1.5 |
| ⑧ | | | S2 | 1.94 | 0.63 |

Note
*Secondary recrystallization undeveloped

From these results, it is apparent that:

(1) in the sample A wherein MnS is used as a main inhibitor, the secondary recrystallization is stable under all the conditions (B8: about 1.86T), whereas in the sample B wherein a nitride of Al is used as a main inhibitor, the secondary recrystallization occurs to provide a product having a high flux density (B8: about 1.93T) only when use is made of the finish annealing cycle S2 wherein a silica film is formed on the surface of the steel sheet before the secondary recrystallization; and (2) in both the samples A and B, an about 0.1 W/kg improvement in the iron loss can be attained by pickling the decarburized steel sheet to remove an oxide film formed in the decarburization annealing.

Figure 2:
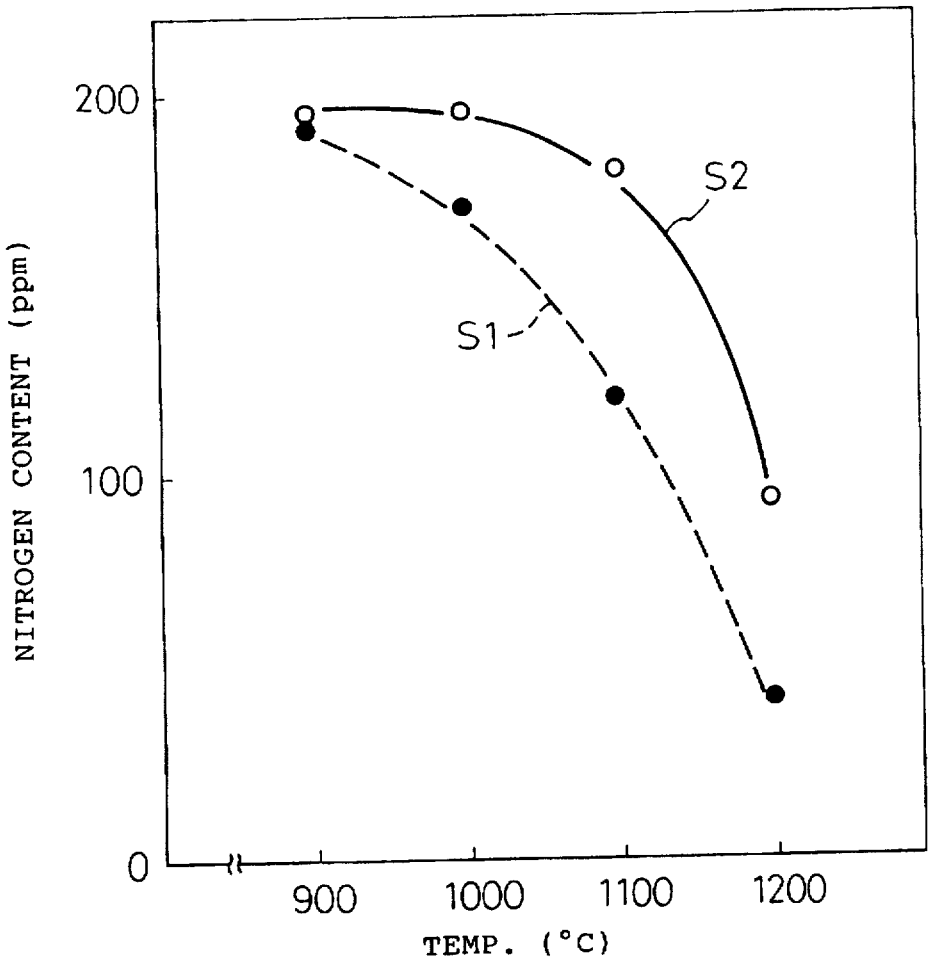
FIG. 2 is a diagram showing the influence of an atmospheric gas on the behavior of a change in an inhibitor (the nitrogen content) during finish annealing.
Figure 3:
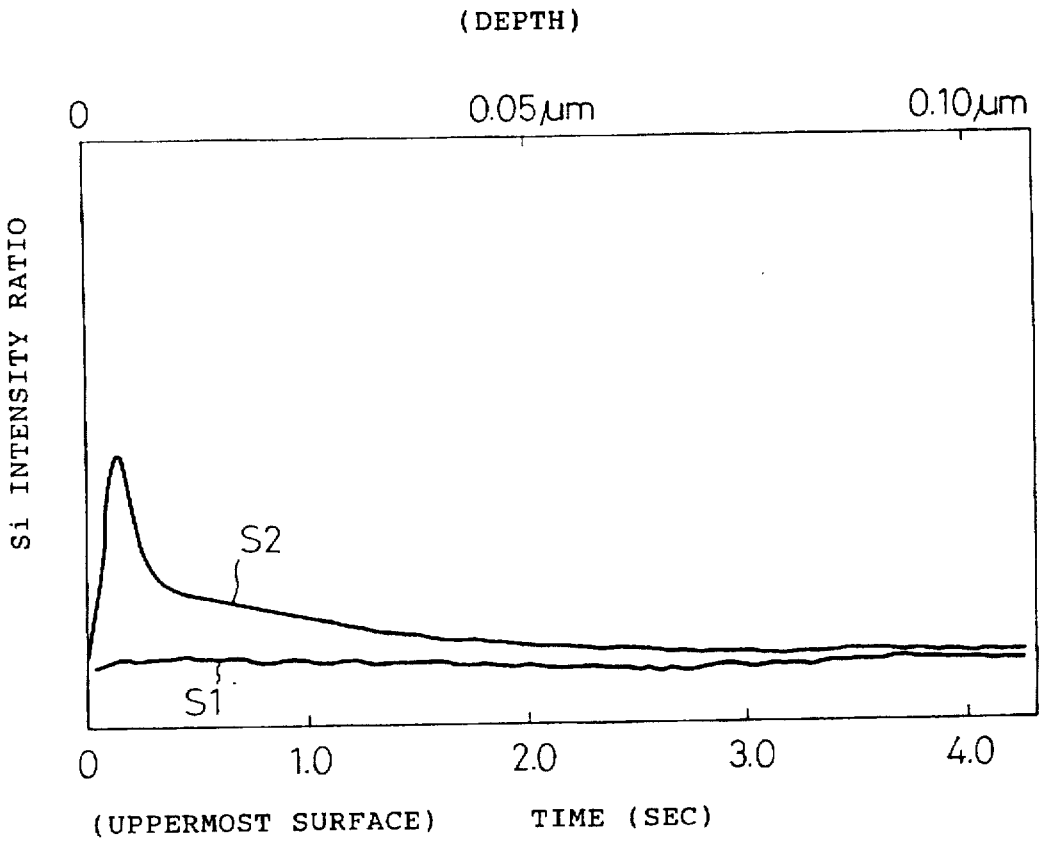
FIG. 3 is a GDS (glow discharge spectroscopy) chart showing the degree of enrichment of silica on the surface of the steel sheet in finish annealing at 900° C.

The results of an examination on a change in the inhibitor (the nitrogen content) for finish annealing cycles S1 and S2 are shown in FIG. 2. When the S1 cycle is compared with a conventional technique where MgO is coated in a water slurry form to form a glass film, it is apparent that, in the S1 cycle, nitrogen rapidly decreases at a temperature of about 1,000° C. at which the secondary recrystallization develops. On the other hand, as shown in FIG. 3, in the S2 cycle wherein a silica film is formed on the surface of the steel sheet, it is apparent that, as with the results of the conventional technique, the steel sheet gives rise to no reduction in nitrogen content until the temperature reaches a temperature range of from 1,000° to 1,100° C. in which the recrystallization structure develops with the inhibitor remaining stable. Thus, the secondary recrystallization can be stabilized to provide products having a high magnetic flux density by regulating the surface of the steel sheet to prevent the denitriding for the purpose of stably maintaining the inhibitor. The iron loss was reduced by about 0.2 W/kg (20%) by improving the magnetic flux density.

In the samples wherein the oxide layer formed in the decarburization anneal has not been removed, fine inclusions are present just under the surface of the samples. These inclusions are not observed in samples wherein the oxide layer formed in the decarburization annealing has been removed by pickling, and, as is apparent from Table 1, an about 0.1 W/kg (10%) reduction in the iron loss ($W_{17/50}$) value can be attained by adopting the pickling.

As is apparent from the foregoing description, the iron loss value of the product can be improved (1) by about 20% by regulating the inhibitor to improve the magnetic flux density of the steel sheet and (2) by about 10% by removing the oxide layer of the decarburized steel sheet to eliminate inclusions present just under the surface. Further, a combination of these two techniques enables the iron loss value to be improved by about 30%.

Embodiments of the present invention will now be described.

The magnetic flux density of the steel sheet can be enhanced by applying a production process proposed by Taguchi, Sakakura et al. wherein AlN and MnS are used as the main inhibitor (see, for example, Japanese Examined Patent Publication (Kokoku) No. 40-15644) or a production process proposed by Komatsu et al. wherein (Al, Si) N is used as the main inhibitor (see, for example, Japanese Examined Patent Publication (Kokoku) No. 62-45285). In this case, as described above, the prevention of denitriding on the surface of the steel sheet to stabilize the inhibitor comprising a nitride of Al is indispensable.

In order to prevent the denitriding, it is useful to effect, prior to the development of secondary recrystallization, (1) the formation of a silica film on the surface of the steel sheet or (2) the enrichment of surface segregation elements, such as Sn, Sb and Pb, on the surface of the steel sheet.

The atmosphere gas just above the steel sheet in a temperature range of from 600° to 900° C. used until the secondary recrystallization develops in the finish annealing may be rendered weakly oxidizing relative to Si (degree of oxidization $pH_2O/pH_2$: 0.01 to 0.1) for the purpose of forming a silica film on the surface of the steel sheet. In this range of degrees of oxidization, a uniform oxide film can be formed by external oxidization of Si contained in the steel to prevent the permeation of nitrogen through the film. When the degree of oxidization is excessively low, the time taken for the silica film to be formed becomes excessively long, which is unfavorable from the practical viewpoint. On the other hand, when the degree of oxidization is excessively high, since a nonuniform silica layer is formed due to internal oxidization, it becomes impossible to prevent the permeation of nitrogen through the film.

The enrichment of surface segregation elements, such as Sn, Sb and Pb, on the surface of the steel sheet is also useful for preventing denitriding. In the samples wherein these surface segregation elements are enriched on the surface of the steel sheet, denitriding during finish annealing can be prevented, which enables the inhibitor to remain stable until the temperature reaches a high temperature, so that the secondary recrystallized structure can be stably developed. These surface segregation elements may be enriched on the surface of the steel sheet before the secondary recrystallization in the finish annealing. In this case, as described above, these elements may be added to a molten steel or may be coated in the form of a simple substance or a compound on the steel sheet in a stage before the finish annealing.

The influence of addition of Sn will now be described as an example with respect to the enrichment of the surface segregation element on the surface of the steel sheet. Silicon steel slabs comprising, in terms of by weight, 3.3% of Si, 0.14% of Mn, 0.05% of C, 0.007% of S, 0.028% of acid soluble Al, 0.008% of N and 0.005 to 0.3% of Sn were hot-rolled into steel sheets having a thickness of 1.6 mm. The hot-rolled sheets were annealed at 1,100° C. for 2 min and cold-rolled into steel sheets having a final thickness of 0.15 mm. The cold-rolled steel sheets were subjected to annealing serving also as decarburization in a moist gas at 850° C. for 70 sec to effect primary recrystallization.

These samples were coated with an annealing separator composed mainly of alumina by electrostatic coating and then subjected to finish annealing.

The finish annealing was effected in an atmosphere of 100% $N_2$ at a temperature rise rate of 15° C./hr until the temperature reached 1,200° C. When the temperature reached 1,200° C., the atmosphere was switched to an atmosphere of 100% of $H_2$ and purification annealing was then effected at that temperature for 20 hr.

These samples were subjected to a tension coating treatment, a magnetic domain division treatment with laser beam irradiation and measurement of magnetic properties. The results are shown in FIG. 4.

Figure 4:
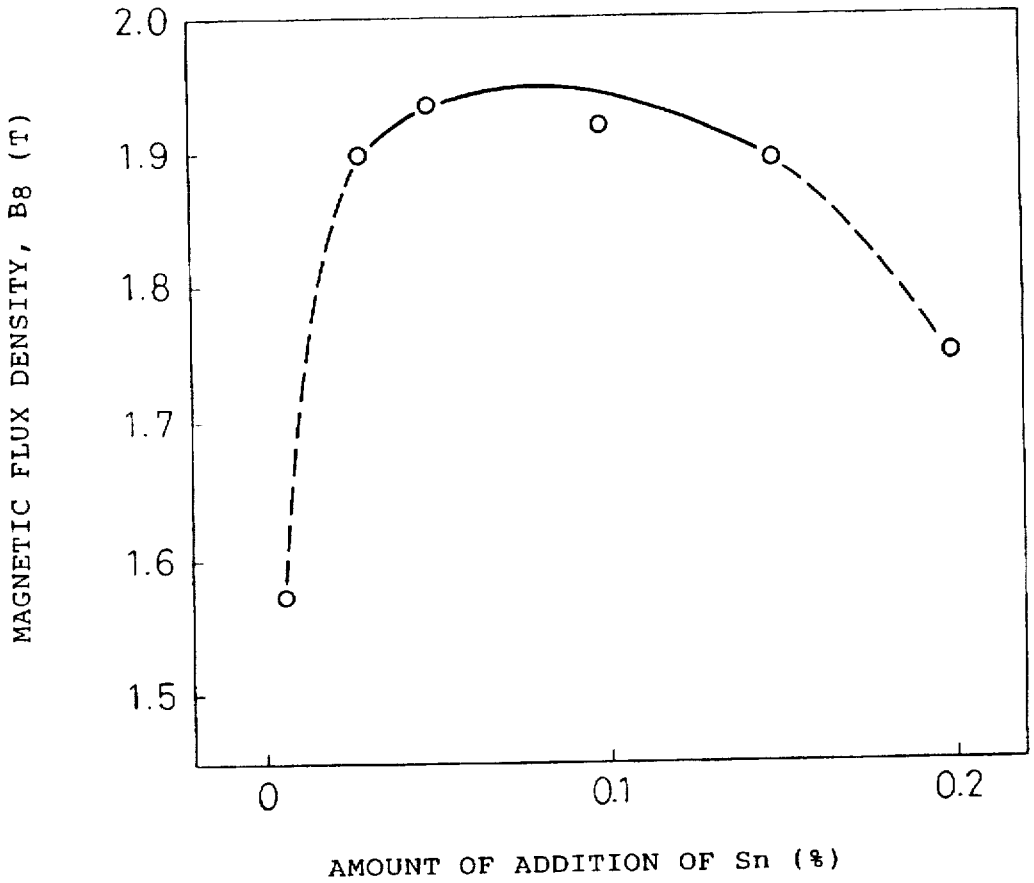
FIG. 4 is a diagram showing an influence of a surface segregation element (Sn) on the magnetic flux density (secondary recrystallization stability)

As is apparent from FIG. 4, in samples wherein Sn has been added in an amount of 0.03 to 0.15%, the secondary recrystallization could be stably effected. The reason why the recrystallization becomes unstable when the amount of addition of Sn is 0.15% or more is believed to be that the secondary recrystallization temperature becomes excessively high.

Figure 5:
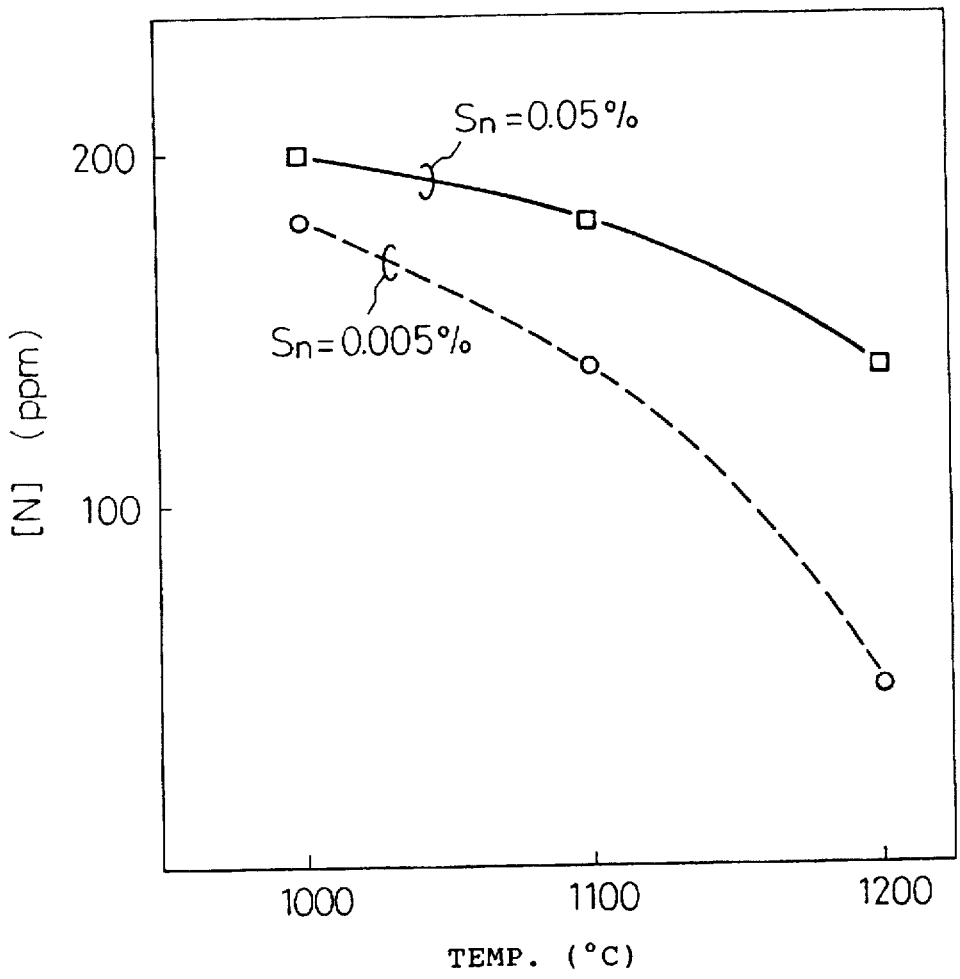
FIG. 5 is a diagram showing the influence of a surface segregation element (Sn) on the behavior of a change in an inhibitor (the nitrogen content) during finish annealing.

As opposed to the conventional technique, when no water slurry is used as the annealing separator, the deterioration in the inhibitors (such as AlN and (Al, Si)N) occurs due to denitriding from the surface. Therefore, in the material wherein Sn has been added, the formation of a layer enriched in Sn on the surface of the steel sheet can reduce the rate of escape of nitrogen. A change in the N content during finish annealing is shown in FIG. 5. From FIG. 5, it is apparent that the effect of inhibiting the denitriding can be attained by adding Sn.

The oxide layer formed in the decarburization annealing can be removed by any of a chemical method, such as pickling, or a physical method, such as mechanical grinding. In general, since the thickness of the decarburized steel sheet is as small as 0.1 to 0.5 mm, pickling is considered convenient for industrial scale.

The annealing separator may be a substance nonreactive or less reactive with silica present on the surface of the steel sheet. Examples of methods useful for using the annealing separator include (1) one wherein a powder of $Al_2O_3$, $SiO_2$, $ZrO_2$, BaO, CaO, SrO or $Mg_2SiO_4$ is used by electrostatic coating or the like in such a state that no water of hydration is carried in the system, (2) one wherein use is made of a steel sheet having a surface layer, such as $Al_2O_3$, $SiO_2$, $ZrO_2$, BaO, CaO, SrO or $Mg_2SiO_4$, and (3) one which comprises preparing a water slurry of a powder of $Al_2O_3$, $SiO_2$, $ZrO_2$, SrO or $Mg_2SiO_4$ having an average particle diameter of 0.5 to 10 μm, coating the slurry on the surface of the steel sheet and drying the steel sheet to remove water of hydration. When the annealing separator is used in the form of a water slurry, if the particle diameter is larger than 10 μm, coarse particles bite into the steel sheet, whereas if the particle is smaller than 0.5 μm, seizing occurs in the steel sheet due to the activity of the particles.

The product after finish annealing is subjected to a tension coating treatment and a magnetic domain division treatment such as laser beam irradiation.

The present invention will now be described with reference to the following Examples.

EXAMPLES

Example 1

A hot-rolled silicon steel strip comprising 3.3% by weight of Si, 0.025% by weight of acid soluble Al, 0.009% by weight of N, 0.07% by weight of Mn, 0.015% by weight of S, 0.08% by weight of C and 0.015% by weight of Se with the balance consisting of Fe and unavoidable impurities was annealed at 1,120° C. for 2 min, and cold-rolled into a steel sheet having a thickness of 0.23 mm.

The cold-rolled steel sheet was subjected to annealing serving also as decarburization in an annealing furnace having a moist atmosphere (dew point: 65° C.) at 850° C. for 2 min to effect primary recrystallization.

Thereafter, the steel sheet was ① transferred to the next step or ② pickled with a mixed solution comprising 0.5% hydrofluoric acid and 5% sulfuric acid. The two types of materials were coated with a water slurry of $Al_2O_3$ having an average particle diameter of 4.0 μm. For comparison, the steel sheet was ③ subjected to no pickling and then coated with an annealing separator composed mainly of a MgO in the form of a water slurry.

These three types of materials were subjected to finish annealing in two types of cycles. In one cycle (S1), the materials were heated at a temperature rise rate of 15° C./hr to 1,200° C. in an atmosphere comprising 15% of $N_2$ and 85% of $H_2$ and having a degree of oxidization of 0.001 or less. On the other hand, in the other cycle (S2), the materials were heated at a temperature rise rate of 15° C./hr to 1,200° C. in an atmosphere comprising 15% of $N_2$ and 85% of $H_2$ and having a degree of oxidization of 0.05. After the temperature reached 1,200° C., the atmosphere was switched to an atmosphere consisting of 100% hydrogen, and the materials were held at that temperature for 20 hr. After the completion of the finish annealing, the materials were subjected to a tension coating treatment with an agent comprising phosphoric acid and chromic acid and then subjected to laser beam irradiation. Properties of the resultant products are given in Table 2.

TABLE 2

| Annealing Separator | Finish Annealing Cycle | Surface | Magnetic Flux Density (B8) (tesla) | Iron Loss $W_{17/50}$ (W/kg) | Remarks |
|---|---|---|---|---|---|
| ① | S1 | Specular surface | 1.68* | >1.5 | Comp. Ex. |
| | S2 | Specular surface | 1.95 | 0.72 | Invention |
| ② | S1 | Specular surface | 1.71* | >1.5 | Comp. Ex. |
| | S2 | Specular surface | 1.94 | 0.63 | Invention |
| ③ | S1 | Glass film | 1.92 | 0.77 | Comp. Ex. |
| | S2 | Glass film | 1.91 | 0.78 | Comp. Ex. |

Note
*Secondary recrystallization undeveloped

Example 2

A 1.4 mm-thick hot-rolled silicon steel sheet comprising 3.3% by weight of Si, 0.029% by weight of acid soluble Al, 0.008% by weight of N, 0.12% by weight of Mn, 0.007% by weight of S and 0.05% by weight of C with the balance consisting of Fe and unavoidable impurities was annealed at 1,100° C. for 2 min, and cold-rolled into a steel sheet having a thickness of 0.15 mm.

The cold-rolled steel sheet was subjected to annealing serving also as decarburization in an annealing furnace having a moist atmosphere at 840° C. for 2 min to effect primary recrystallization. In order to stabilize the secondary recrystallization, the annealed steel sheet was then nitrided in an ammonia atmosphere to a total nitrogen content of 190 ppm, thereby strengthening the inhibitor.

Thereafter, the oxide layer formed on the surface of the steel sheet was removed with a mixture of sulfuric acid with hydrofluoric acid, and the steel sheet was ① coated with $Al_2O_3$ having an average particle diameter of 2.0 μm as an annealing separator by electrostatic coating, ② subjected to thermal spray with $Al_2O_3$ as an annealing separator, ③ coated with a water slurry of $Al_2O_3$ having an average particle diameter of 2.0 μm as an annealing separator to form a coating which was then dried, and, for comparison purpose, ④ coated with MgO in the form of a water slurry (a conventional method)

These three types of materials were heated at a temperature rise rate of 10° C./hr to 1,200° C. in an atmosphere gas consisting of 100% of $N_2$. After the temperature reached 1,200° C., the atmosphere was switched to an atmosphere consisting of 100% hydrogen, and the materials were held at that temperature for 20 hr. After the completion of the finish annealing, the materials were subjected to a tension coating treatment with an agent comprising phosphoric acid and chromic acid and then subjected to laser beam irradiation to effect magnetic domain division. Properties of the resultant products are given in Table 3.

TABLE 3

| Annealing Separator | Surface Appearance After Finish Annealing | Magnetic Flux Density (B8) (tesla) | Iron Loss $W_{17/50}$ (w/kg) | Remarks |
|---|---|---|---|---|
| ① | Smooth surface (Specular surface) | 1.95 | 0.51 | Invention |
| ② | Smooth surface (Specular surface) | 1.94 | 0.52 | Invention |
| ③ | Smooth surface (Specular surface) | 1.94 | 0.53 | Invention |
| ④ | Glass Film | 1.93 | 0.67 | Comp. Ex. |

Example 3

A silicon steel slab comprising, in terms of by weight, 3.3% of Si, 0.12% of Mn, 0.05% of C, 0.007% of S, 0.026% of acid soluble Al, 0.008% of N and 0.01% of Pb was heated to 1,150° C. and hot-rolled into a steel sheet having a thickness of 1.8 mm. The hot-rolled steel sheet was annealed at 1,100° C. for 2 min and then cold-rolled into a steel sheet having a final thickness of 0.2 mm. The cold-rolled steel sheet was subjected to annealing serving also as decarburization in a moist atmosphere at 850° C. for 70 sec to effect primary recrystallization. Thereafter, the steel sheet was annealed in an ammonia atmosphere at 750° C. to increase the nitrogen content to 0.02%, thereby strengthening the inhibitor. Thereafter, the steel sheet was pickled to remove the oxide layer formed on the surface of the steel sheet. (1) Part of this steel sheet was coated with a water slurry of alumina having an average particle diameter of 1 μm, while (2) the other part of the steel sheet was coated with a water slurry of magnesia. They were put on top of another and then subjected to finish annealing.

The finish annealing was effected in an atmosphere gas consisting of 100% $N_2$ at a temperature rise rate of 10° C./hr until the temperature reached 1,200° C. When the temperature reached 1,200° C., the atmosphere was switched to one consisting of 100% $H_2$ and purification annealing was effected at that temperature for 20 hr.

These samples were subjected to a tension coating treatment and then subjected to laser beam irradiation to effect magnetic domain division. Magnetic properties of the resultant products are given in Table 4.

TABLE 4

| Sample No. | Magnetic Flux Density (B8) (T) | Iron Loss $W_{17/50}$ (w/kg) | Remarks |
|---|---|---|---|
| 1 | 1.93 | 0.62 | Invention |
| 2 | 1.93 | 0.71 | Comp. Ex. |

It is apparent that coating of alumina can provide an about 10% reduction (improvement) in the iron loss value as compared with coating of magnesia in the form of a water slurry.

Example 4

A silicon steel slab comprising, in terms of by weight, 3.2% of Si, 0.08% of Mn, 0.08% of C, 0.025% of S, 0.025% of acid soluble Al, 0.009% of N and 0.008% of Pb was heated to 1,320° C. and hot-rolled into a steel sheet having a thickness of 1.8 mm. The hot-rolled steel sheet was annealed at 1,050° C. for 2 min and then cold-rolled into a steel sheet having a thickness of 0.20 mm. The cold-rolled steel sheet was subjected to annealing serving also as decarburization in a moist gas at 850° C. for 90 sec to effect primary recrystallization. Thereafter, (A) part of the steel sheet was pickled to remove the oxide layer formed on the surface of the steel sheet, while (B) other part of the steel sheet, as such, was coated with a water slurry of alumina having an average particle diameter of 1.0 μm to form a coating which was then dried. They were then subjected to finish annealing.

The finish annealing was effected in an atmosphere gas consisting of 100% Ar at a temperature rise rate of 15° C./hr until the temperature reached 1,200° C. When the temperature reached 1,200° C., the atmosphere was switched to an atmosphere consisting of 100% $H_2$ and purification annealing was then effected at that temperature for 20 hr.

These samples were subjected to a tension coating treatment and then subjected to laser beam irradiation to effect magnetic domain division. Magnetic properties of the resultant products are given in Table 5.

TABLE 5

| Sample No. | Magnetic Flux Density (B8) (T) | Iron Loss $W_{17/50}$ (w/kg) | Remarks |
|---|---|---|---|
| A | 1.92 | 0.67 | Invention |
| B | 1.92 | 0.61 | Invention |

It is apparent that removal of the oxide layer formed in the decarburization annealing contributes to a further improvement (reduction) in the iron loss.

Example 5

A silicon steel slab comprising, in terms of by weight, 3.3% of Si, 0.12% of Mn, 0.05% of C, 0.007% of S, 0.028% of acid soluble Al, 0.008% of N and (A) 0.01%, (B) 0.05% or (C) 0.1% of Sb was heated to 1,150° C. and hot-rolled into a steel sheet having a thickness of 1.6 mm. The hot-rolled steel sheet was annealed at 1,100° C. for 2 min and then cold-rolled into a steel sheet having a final thickness of 0.15 mm. The cold-rolled steel sheet was subjected to annealing serving also as decarburization in a moist gas at 830° C. for 70 sec to effect primary recrystallization. Thereafter, the steel sheet was annealed in an ammonia atmosphere at 750° C. to increase the nitrogen content to 0.02%, thereby strengthening the inhibitor. (1) Part of this steel sheet was pickled and coated with alumina by electrostatic coating, while (2) the other part of the steel sheet was coated with a water slurry of magnesia. They were then subjected to finish annealing.

The finish annealing was effected in an atmosphere gas consisting of 100% $N_2$ at a temperature rise rate of 10° C./hr until the temperature reached 1,200° C. When the temperature reached 1,200° C., the atmosphere was switched to an atmosphere consisting of 100% $H_2$ and purification annealing was then effected at that temperature for 20 hr.

These samples were subjected to a tension coating treatment and then subjected to laser beam irradiation to effect magnetic domain division. Magnetic properties of the resultant products are given in Table 6.

TABLE 6

| Sample No. | Magnetic Flux Density (B8) (T) | Iron Loss $W_{17/50}$ (w/kg) | Remarks |
|---|---|---|---|
| A1 | 1.76 | — | Comp. Ex. |
| A2 | 1.89 | 0.72 | Comp. Ex. |
| B1 | 1.93 | 0.55 | Invention |
| B2 | 1.91 | 0.66 | Comp. Ex. |
| C1 | 1.90 | 0.61 | Invention |
| C2 | 1.90 | 0.69 | Comp. Ex. |

It is apparent that coating of alumina by electrostatic coating can provide a reduction (an improvement) in the iron loss value over coating of magnesia in the form of a water slurry.

Example 6

A silicon steel slab comprising, in terms of by weight, 3.2% of Si, 0.08% of Mn, 0.08% of C, 0.025% of S, 0.026% of acid soluble Al, 0.009% of N and 0.1% of Sn was heated to 1,320° C. and hot-rolled into a steel sheet having a thickness of 2.3 mm. The hot-rolled steel sheet was annealed at 1,050° C. for 2 min, cold-rolled into a steel sheet having a thickness of 1.4 mm, and further annealed at 1,120° C. for 2 min. Thereafter, the annealed steel sheet was cold-rolled into a steel sheet having a final thickness of 0.15 mm. The cold-rolled steel sheet was subjected to annealing serving also as decarburization in a moist gas at 850° C. for 90 sec to effect primary recrystallization. Thereafter, the steel sheet was pickled to remove the oxide layer present on the surface of the steel sheet, and (1) part of this steel sheet was coated with alumina by electrostatic coating, while (2) other part of the steel sheet was coated with a water slurry of magnesia. They were put on top of another and then subjected to finish annealing.

The finish annealing was effected in an atmosphere gas consisting of 100% Ar at a temperature rise rate of 15° C./hr until the temperature reached 1,200° C. When the temperature reached 1,200° C., the atmosphere was switched to an atmosphere consisting of 100% $H_2$ and purification annealing was then effected at that temperature for 20 hr.

These samples were subjected to a tension coating treatment and then subjected to laser beam irradiation to effect magnetic domain division. Magnetic properties of the resultant products are given in Table 7.

TABLE 7

| Sample No. | Magnetic Flux Density (B8) (T) | Iron Loss $W_{17/50}$ (w/kg) | Remarks |
|---|---|---|---|
| A | 1.93 | 0.55 | Invention |
| B | 1.91 | 0.67 | Comp. Ex. |

Example 7

A silicon steel slab comprising, in terms of by eight, 3.3% of Si, 0.12% of Mn, 0.05% of C, 0.007% of S, 0.026% of acid soluble Al and 0.008% of N with the balance consisting essentially of Fe and unavoidable impurities was heated to 1,150° C. and hot-rolled into a steel sheet having a thickness of 2.0 mm. The hot-rolled steel sheet was annealed at 1,100° C. for 2 min and cold-rolled into a steel sheet having a final thickness of 0.23 mm. The cold-rolled steel sheet was subjected to annealing, serving also as decarburization, in a moist gas at 850° C. for 70 sec to effect primary recrystallization. Then, the steel sheet was annealed in an ammonia atmosphere at 750° C. to increase the nitrogen content to 0.02%, thereby strengthening the inhibitor. Thereafter, the steel sheet was pickled to remove the oxide layer present on the surface of the steel sheet. Part of the steel sheet was coated with a powder of (A) $Al_2O_3$, (B) $Al_2O_3$+Sn, (C) $Al_2O_3$+Sb, (D) $Al_2O_3$+Pb, (E) $Al_2O_3$+SnO or (F) $Al_2O_3$+PbO by electrostatic coating, while (G) other part of the steel sheet was coated with a water slurry of MgO. They were put on top of another and then subjected to finish annealing.

The finish annealing was effected in an atmosphere comprising 25% $N_2$ and 75% $H_2$ at a temperature rise rate of 15° C./hr until the temperature reached 1,200° C. When the temperature reached 1,200° C., the atmosphere was switched to an atmosphere consisting of 100% $H_2$ and purification annealing was then effected at that temperature for 20 hr.

These samples were subjected to a tension coating treatment and then subjected to laser beam irradiation to effect magnetic domain division. Magnetic properties of the resultant products are given in Table 8.

TABLE 8

| Sample No. | Magnetic Flux Density (B8) (T) | Iron Loss $W_{17/50}$ (w/kg) | Remarks |
|---|---|---|---|
| A | 1.65* | >1.5 | Comp. Ex. |
| B | 1.93 | 0.64 | Invention |
| C | 1.92 | 0.65 | Invention |
| D | 1.93 | 0.63 | Invention |
| E | 1.92 | 0.65 | Invention |
| F | 1.92 | 0.65 | Invention |
| G | 1.91 | 0.78 | Comp. Ex. |

It is apparent that the secondary recrystallization can be stably developed by adding, as an annealing separator, a surface segregation element or a compound of such an element and enriching the element on the surface of the steel sheet during finish annealing.

Further, it is also apparent that coating of alumina by electrostatic coating can provide a lower (better) iron loss value than coating of magnesia in the form of a water slurry.

Example 8

A silicon steel slab comprising, in terms of by weight, 3.2% of Si, 0.08% of Mn, 0.08% of C, 0.08% of S, 0.025% of acid soluble Al and 0.009% of N with the balance consisting essentially of Fe and unavoidable impurities was heated to 1,320° C. and hot-rolled into a steel sheet having a thickness of 2.0 mm. The hot-rolled steel sheet was annealed at 1,050° C. for 2 min, rolled into a steel sheet having a thickness of 1.4 mm and then annealed at 1,000° C. for 2 min. (A) Part of the steel sheet was plated with Sn (0.01 g/m$^2$), while (B) the other part of steel sheet, as such, was further cold-rolled into a steel sheet having a thickness of 0.14 mm. The cold-rolled steel sheet was subjected to annealing, serving also as decarburization, in a moist gas at 850° C. for 90 sec to effect primary recrystallization. Then, the steel sheet was pickled to remove the oxide layer present on the surface of the steel sheet. The steel sheet was coated with a water slurry of alumina having an average particle diameter of 2.0 μm to form a coating which was then dried. The steel sheets were then subjected to finish annealing.

The finish annealing was effected in an atmosphere consisting of 100% Ar at a temperature rise rate of 15° C./hr until the temperature reached 1,200° C. When the temperature reached 1,200° C., the atmosphere was switched to an atmosphere consisting of 100% $H_2$ and purification annealing was then effected at that temperature for 20 hr.

These samples were subjected to a tension coating treatment and then subjected to laser beam irradiation to effect magnetic domain division. Magnetic properties of the resultant products are given in Table 9.

TABLE 9

| Sample No. | Magnetic Flux Density (B8) (T) | Iron Loss $W_{17/50}$ (w/kg) | Remarks |
|---|---|---|---|
| A | 1.91 | 0.59 | Invention |
| B | 1.65* | >1.5 | Comp. Ex. |

Note)*: Secondary recrystallization undeveloped

Example 9

A hot-rolled silicon steel strip comprising 3.3% by weight of Si, 0.025% by weight of acid soluble Al, 0.009% by weight of N, 0.07% by weight of Mn, 0.015% by weight of S, 0.08% by weight of C, 0.015% by weight of Se, 0.13% by weight of Sn and 0.07% by weight of Cu with the balance consisting of Fe and unavoidable impurities was annealed at 1,120° C. for 2 min, and cold-rolled into a steel sheet having a thickness of 0.20 mm.

The cold-rolled steel sheet was subjected to annealing serving also as decarburization in an annealing furnace having a moist atmosphere (dew point: 65° C.) at 850° C. for 2 min to effect primary recrystallization.

Thereafter, the steel sheet was ① transferred to the next step or ② pickled with a mixed solution comprising 0.5% of hydrofluoric acid and 5% of sulfuric acid. The two types of materials were coated with a water slurry of $Al_2O_3$ having an average particle diameter of 4.0 μm. For comparison, ③ the steel sheet was coated with an annealing separator composed mainly of a MgO in the form of a water slurry without pickling.

These three types of materials were heated at a temperature rise rate of 15° C./hr to 1,200° C. in an atmosphere comprising 25% $N_2$ and 75% $H_2$. After the temperature reached 1,200° C., the atmosphere was switched to an atmosphere consisting of 100% hydrogen, and the materials were held at that temperature for 20 hr. After the completion of the finish annealing, the materials were irradiated with a laser beam and then subjected to a tension coating treatment with an agent comprising phosphoric acid and chromic acid. Properties of the resultant products are given in Table 10.

TABLE 10

| Surface Appearance Before Finish Annealing And Annealing Separator | Surface Appearance After Finish Annealing | Magnetic Flux Density (B8) (tesla) | Iron Loss $W_{13/50}$ (W/kg) | Remarks |
|---|---|---|---|---|
| ① | Smooth surface (Specular surface) | 1.89 | 0.35 | Invention |
| ② | Smooth surface (Specular surface) | 1.90 | 0.33 | Invention |
| ③ | Glass | 1.90 | 0.40 | Comp. Ex. |

It is apparent that the products provided according to the process of the present invention exhibit a good property (a low iron loss) even at a low magnetic field (1.3 T).

Example 10

A hot-rolled silicon steel strip comprising 3.2% by weight of Si, 0.029% by weight of acid soluble Al, 0.008% by weight of N, 0.13% by weight of Mn, 0.007% by weight of S and 0.05% by weight of C with the balance consisting of Fe and unavoidable impurities was annealed at 1,100° C. for 2 min, and cold-rolled into a steel sheet having a thickness of 0.18 mm.

The cold-rolled steel sheet was subjected to annealing, serving also as decarburization, in an annealing furnace having a moist atmosphere at 820° C. for 2 min to effect primary recrystallization. Then, in order to stabilize the secondary recrystallization, the annealed steel sheet was nitrided in an ammonia atmosphere to a total nitrogen content of 190 ppm, thereby strengthening the inhibitor.

Thereafter, the steel sheet was ① treated with a mixture of sulfuric acid with hydrofluoric acid to remove the oxide layer formed on the surface of the steel sheet and then coated with a water slurry of $Al_2O_3$ having an average particle diameter of 2.0 μm as an annealing separator, ② coated with a water slurry of $Al_2O_3$ having an average particle diameter of 2.0 μm as an annealing separator, and ③ coated with a water slurry of an annealing separator composed mainly of MgO.

These three types of materials were heated at a temperature rise rate of 30° C./hr to 1,200° C. in an atmosphere comprising 25% $N_2$ and 75% $H_2$. After the temperature reached 1,200° C., the atmosphere was switched to an atmosphere consisting of 100% hydrogen, and the materials were held at that temperature for 20 hr. After the completion of the finish annealing, the materials were irradiated with a laser beam and then subjected to a tension coating treatment with an agent comprising phosphoric acid and chromic acid. Properties of the resultant products are given in Table 11.

TABLE 11

| Surface Appearance Before Finish Annealing And Annealing Separator | Surface Appearance After Finish Annealing | Magnetic Flux Density (B8) (tesla) | Iron Loss $W_{13/50}$ (W/kg) | Remarks |
|---|---|---|---|---|
| ① | Smooth surface (Specular surface) | 1.95 | 0.29 | Invention |
| ② | Smooth surface (Specular surface) | 1.92 | 0.32 | Invention |
| ③ | Glass | 1.93 | 0.37 | Comp. Ex. |

Example 11

A hot-rolled silicon steel strip comprising 3.2% by weight of Si, 0.030% by weight of acid soluble Al, 0.008% by weight of N, 0.13% by weight of Mn, 0.007% by weight of S and 0.05% by weight of C with the balance consisting of Fe and unavoidable impurities was annealed at 1,100° C. for 2 min, and cold-rolled into a steel sheet having a thickness of 0.15 mm.

The cold-rolled steel sheet was subjected to annealing, serving also as decarburization, in an annealing furnace having a moist atmosphere at 820° C. for 2 min to effect primary recrystallization. In order to stabilize the secondary recrystallization, the annealed steel sheet was then nitrided in an ammonia atmosphere to a total nitrogen content of 200 ppm, thereby strengthening the inhibitor.

Thereafter, the steel sheet was treated with a mixture of sulfuric acid and hydrofluoric acid to remove the oxide layer formed on the surface of the steel sheet, and then ① coated with a water slurry of $Al_2O_3$ having an average particle diameter of 2.0 μm as an annealing separator and heated to 1,200° C. in an atmosphere consisting of 100% $H_2$, ② coated with a water slurry of $Al_2O_3$ having an average particle diameter of 2.0 μm as an annealing separator and heated to 1,200° C. in an atmosphere comprising 5% of $N_2$ and 95% of $H_2$, ③ coated with a water slurry of $Al_2O_3$ having an average particle diameter of 2.0 μm as an annealing separator and heated to 1,200° C. in an atmosphere comprising 75% of $N_2$ and 25% of $H_2$, and, for comparison purpose, ④ coated with a water slurry of MgO as an annealing separator and heated to 1,200° C. in an atmosphere comprising 5% $N_2$ and 95% $H_2$. In each case, heating to 1,200° C. was effected at a temperature rise rate of 30° C./hr. After the temperature reached 1,200° C., the atmosphere was switched to an atmosphere consisting of 100% hydrogen, and the materials were held at that temperature for 20 hr.

After the completion of the finish annealing, the materials were irradiated with a laser beam and then subjected to a tension coating treatment with an agent comprising phosphoric acid and chromic acid. Properties of the resultant products are given in Table 12.

TABLE 12

| Annealing Separator And Finish Annealing Atmosphere | Surface Appearance After Finish Annealing | Magnetic Flux Density (B8) (tesla) | Iron Loss $W_{13/50}$ (W/kg) | Remarks |
|---|---|---|---|---|
| ① | Smooth surface (Specular surface) | 1.92 | 0.31 | Invention |
| ② | Smooth surface (Specular surface) | 1.95 | 0.26 | Invention |
| ③ | Smooth surface (Specular surface) | 1.96 | 0.25 | Invention |
| ④ | (Glass) Dull gloss | 1.92 | 0.39 | Comp. Ex. |

The formation of a small amount of a glass film was observed in the material wherein a water slurry of MgO was used as the annealing separator. This rendered the smoothness of the surface of the steel sheet so unsatisfactory that the magnetic properties of the steel sheet were poor.

Example 12

A primary recrystallized steel sheet was prepared in the same manner as that of Example 11. In order to stabilize the secondary recrystallization, the steel sheet was then nitrided in an ammonia atmosphere to a total nitrogen content of 210 ppm, thereby strengthening the inhibitor.

Thereafter, the steel sheet was treated with a mixture of sulfuric acid with hydrofluoric acid to remove the oxide layer formed on the surface of the steel sheet, and then ① coated with alumina ($Al_2O_3$) having an average particle diameter of 2.0 μm as an annealing separator by electrostatic coating and heated to 1,200° C. in an atmosphere consisting of 100% $H_2$, ② coated with alumina ($Al_2O_3$) having an average particle diameter of 2.0 μm as an annealing separator by electrostatic coating and heated to 1,200° C. in an atmosphere comprising 5% $N_2$ and 95% $H_2$, ③ coated with alumina ($Al_2O_3$) having an average particle diameter of 2.0 μm as an annealing separator by electrostatic coating and heated to 1,200° C. in an atmosphere comprising 75% $N_2$ and 25% $H_2$, and, for comparison purpose, ④ coated with a water slurry of MgO as an annealing separator and heated to 1,200° C. in an atmosphere comprising 5% $N_2$ and 95% $H_2$. In each case, heating to 1,200° C. was effected at a temperature rise rate of 30° C./hr. After the temperature reached 1200° C., the atmosphere was switched to an atmosphere consisting of 100% hydrogen, and the materials were held at that temperature for 20 hr.

After the completion of the finish annealing, the materials were irradiated with a laser beam and then subjected to a tension coating treatment with an agent comprising phosphoric acid and chromic acid. Properties of the resultant products are given in Table 13.

TABLE 13

| Annealing Separator And Finish Annealing Atmosphere | Surface Appearance After Finish Annealing | Magnetic Flux Density (B8) (tesla) | Iron Loss $W_{13/50}$ (W/kg) | Remarks |
|---|---|---|---|---|
| ① | Smooth surface (Specular surface) | 1.93 | 0.30 | Invention |
| ② | Smooth surface (Specular surface) | 1.95 | 0.25 | Invention |
| ③ | Smooth surface (Specular surface) | 1.96 | 0.25 | Invention |
| ④ | (Glass) Dull gloss | 1.93 | 0.38 | Comp. Ex. |

The formation of a small amount of a glass film was observed in the material wherein a water slurry of MgO was used as the annealing separator. This rendered the smoothness of the surface of the steel sheet so unsatisfactory that the magnetic properties of the steel sheet were poor.

Example 13

A hot-rolled silicon steel strip comprising 3.2% by weight of Si, 0.030% by weight of acid soluble Al, 0.007% by weight of N, 0.14% by weight of Mn, 0.007% by weight of S and 0.05% by weight of C with the balance consisting of Fe and unavoidable impurities was annealed at 1,100° C. for 2 min, and cold-rolled into a steel sheet having a thickness of 0.15 mm.

The cold-rolled steel sheet was subjected to annealing, serving also as decarburization, in an annealing furnace having a moist atmosphere at 850° C. for 2 min to effect primary recrystallization. In order to stabilize the secondary recrystallization, the annealed steel sheet was then nitrided in an ammonia atmosphere to a total nitrogen content of 200 ppm, thereby strengthening the inhibitor.

Thereafter, the steel sheet was treated with a mixture of sulfuric acid with hydrofluoric acid to remove the oxide layer formed on the surface of the steel sheet, and then ① coated with a water slurry of alumina ($Al_2O_3$) having an average particle diameter of 0.3 μm as an annealing separator, ② coated with a water slurry of alumina ($Al_2O_3$) having an average particle diameter of 0.5 μm as an annealing separator, ③ coated with a water slurry of alumina ($Al_2O_3$) having an average particle diameter of 3.0 μm as an annealing separator, ④ coated with a water slurry of alumina ($Al_2O_3$) having an average particle diameter of 10.0 μm as an annealing separator, ⑤ coated with a water slurry of alumina ($Al_2O_3$) having an average particle diameter of 14.9 μm as an annealing separator, and ⑥ coated with a water slurry of alumina ($Al_2O_3$) having an average particle diameter of 35 μm as an annealing separator.

These materials were heated at a temperature rise rate of 30° C./hr to 1,200° C. in an atmosphere comprising 75% $N_2$ and 25% $H_2$. After the temperature reached 1,200° C., the atmosphere was switched to an atmosphere consisting of 100% of hydrogen, and the materials were held at that temperature for 20 hr. After the completion of the finish annealing, the materials were irradiated with a laser beam and then subjected to a tension coating treatment with an agent comprising phosphoric acid and chromic acid. Properties of the resultant products are given in Table 14.

TABLE 14

| Surface Appearance Before Finish Annealing | Surface Appearance After Finish Annealing | Magnetic Flux Density (B8) (tesla) | Iron Loss $W_{13/50}$ (w/kg) | Remarks |
|---|---|---|---|---|
| ① | Alumina sintered surface | 1.95 | 0.30 | Comp. Ex. |
| ② | Smooth surface (Specular surface | 1.95 | 0.26 | Invention |
| ③ | Smooth surface (Specular surface) | 1.94 | 0.25 | Invention |
| ④ | Smooth surface (Specular surface) | 1.95 | 0.26 | Invention |
| ⑤ | Rough metallic surface | 1.94 | 0.29 | Comp. Ex. |
| ⑥ | Rough metallic surface | 1.93 | 0.32 | Comp. Ex. |

When alumina having an average particle diameter of less than 0.5 μm was used as the annealing separator, a sinter of alumina was deposited on the surface of the steel sheet. On the other hand, when alumina having an average particle diameter exceeding 10.0 μm was used as the annealing separator, alumina particles bit into the steel sheet, which caused the roughness of the surface of the steel sheet to become so large that the roughness could be confirmed with a finger and the alumina present on the surface of the steel sheet could be confirmed by observation under an electron microscope.

Example 14

A cold-rolled steel sheet was prepared in the same manner as that of Example 11. The cold-rolled steel sheet was subjected to annealing, serving also as decarburization, in an annealing furnace having a moist atmosphere at 840° C. for 2 min to effect primary recrystallization. In order to stabilize the secondary recrystallization, the steel sheet was then nitrided in an ammonia atmosphere to a total nitrogen content of 210 ppm, thereby strengthening the inhibitor. Thereafter, the steel sheet was treated with a mixture of sulfuric acid and hydrofluoric acid to remove the oxide layer formed on the surface of the steel sheet, and then ① coated with alumina ($Al_2O_3$) having an average particle diameter of 0.3 μm as an annealing separator by electrostatic coating, ② coated with alumina ($Al_2O_3$) having an average particle diameter of 3.0 μm as an annealing separator by electrostatic coating, ③ coated with silica having an average particle diameter of 3.0 μm as an annealing separator by electrostatic coating, ④ coated with zirconia having an average particle diameter of 3.3 μm as an annealing separator by electrostatic coating, ⑤ coated with strontium oxide having an average particle diameter of 3.0 μm as an annealing separator by electrostatic coating, and ⑥ coated with forsterite having an average particle diameter of 3.0 μm as an annealing separator by electrostatic coating. These materials were heated at a temperature rise rate of 30° C./hr to 1,200° C. in an atmosphere comprising 75% of $N_2$ and 25% of $H_2$. After the temperature reached 1,200° C., the atmosphere was switched to an atmosphere consisting of 100% hydrogen, and the materials were held at that temperature for 20 hr. After the completion of the finish annealing, the materials were irradiated with a laser beam and then subjected to a tension coating treatment with an agent comprising phosphoric acid and chromic acid. Properties of the resultant products are given in Table 15.

TABLE 15

| Annealing Separator | Surface Appearance After Finish Annealing | Magnetic Flux Density (B8) (tesla) | Iron Loss $W_{13/50}$ (w/kg) | Remarks |
|---|---|---|---|---|
| ① | Alumina sintered | 1.94 | 0.33 | Comp. Ex. |
| ② | Smooth surface (Specular surface | 1.94 | 0.27 | Invention |
| ③ | Smooth (Specular surface) | 1.95 | 0.27 | Invention |
| ④ | Smooth surface (Specular surface) | 1.96 | 0.26 | Invention |
| ⑤ | Smooth surface Specular surface) | 1.96 | 0.26 | Invention |
| ⑥ | Smooth surface (Specular surface) | 1.94 | 0.29 | Invention |

[Industrial Applicability]

According to the present invention, a grain oriented electrical steel sheet having a surface that has little unevenness causative of the inhibition of magnetic properties, i.e., a specular surface, can be easily provided, and a magnetic material having a very low iron loss can be provided by subjecting the steel sheet to a laser beam irradiation treatment for division of magnetic domains and a tension coating treatment. In the production of a grain oriented electrical steel sheet according to the present invention, since the treatment for rendering the surface of the steel sheet specular can be very easily effected in a conventional finish annealing furnace, the present invention is very valuable from the viewpoint of industry.

We claim:

1. A process for producing a grain oriented silicon steel sheet employing an aluminum nitride inhibitor comprising:

providing a steel material consisting essentially of, in terms of weight percent, 0.8 to 4.8% of Si, 0.012 to 0.05% of acid soluble Al, and 0.01% or less of N with the balance being essentially Fe and unavoidable impurities;

forming said steel material into a steel sheet, said steel sheet having a surface;

subjecting said steel sheet to decarburization annealing and then nitriding after decarburization annealing;

coating an annealing separator on the surface of said steel sheet, wherein said annealing separator is at least one member selected from the group consisting of $Al_2O_3$, $SiO_2$, $ZrO_2$, BaO, CaO, SrO, and $MgSiO_4$, whereby said annealing separator is disposed between adjacent steel sheet surfaces during finish annealing;

preventing occurrence of denitriding of said steel sheet during finish annealing by forming prior to secondary recrystallization taking place a structure means on the surface of said steel sheet for preventing said occurrence of said denitriding during finish annealing, wherein glass film is absent from said structure means;

finish annealing said steel sheet coated with said annealing separator thereby providing a steel sheet having a surface with glass film formation being absent on said surface.

2. A process for producing a grain oriented silicon steel sheet employing an aluminum nitride inhibitor comprising:

providing a steel material consisting essentially of, in terms of weight percent, 0.8 to 4.8% of Si, 0.012 to 0.05% of acid soluble Al, 0.01% or less of N, 0.02 to 0.3% of Mn, and 0.005 to 0.040% of S with the balance being essentially Fe and unavoidable impurities;

forming said steel material into a steel sheet, said steel sheet having a surface, including cold rolling said steel sheet one or more times, with intermediate annealing effected between cold rollings if there is more than one cold rolling;

after cold rolling, subjecting said steel sheet to decarburization annealing;

coating an annealing separator on the surface of said steel sheet, wherein said annealing separator is at least one member selected from the group consisting of $Al_2O_3$, $SiO_2$, $ZrO_2$, BaO, CaO, SrO, and $MgSiO_4$, whereby said annealing separator is disposed between adjacent steel sheet surfaces during finish annealing;

preventing occurrence of denitriding of said steel sheet during finish annealing by forming prior to secondary recrystallization taking place a structure means on the surface of said steel sheet for preventing said occurrence of said denitriding during finish annealing, wherein glass film is absent from said structure means;

finish annealing said steel sheet coated with said annealing separator thereby providing a steel sheet having a surface with glass film formation being absent on said surface.

3. A process according to claim 1 or 2 further comprising coating at least one member selected from the group consisting of $Al_2O_3$, $SiO_2$, $ZrO_2$, BaO, SrO, and $Mg_2SiO_4$ as the annealing separator on the surface of the steel sheet, said coating taking place in a manner such that there is no water of hydration in the coating.

4. A process for producing a grain oriented silicon steel sheet employing an aluminum nitride inhibitor comprising:

providing a steel material consisting essentially of, in terms of weight percent, 0.8 to 4.8% of Si, 0.012 to 0.05% of acid soluble Al, and 0.01% or less of N with the balance being essentially Fe and unavoidable impurities;

forming said steel material into a steel sheet, said steel sheet having a surface;

subjecting said steel sheet to decarburization annealing and then nitriding after decarburization annealing;

coating an annealing separator on the surface of said steel sheet wherein said annealing separator is at least one member selected from the group consisting of $Al_2O_3$, $SiO_2$, $ZrO_2$, BaO, CaO, SrO, and $MgSiO_4$, whereby said annealing separator is disposed between adjacent steel sheet surfaces during finish annealing;

preventing occurrence of denitriding of said steel sheet during finish annealing by maintaining an atmosphere during finish annealing prior to secondary recrystallization that is weakly oxidizing relative to Si wherein $pH_2O/pH_2$ is 0.01 to 0.1, thereby forming by external oxidation a $SiO_2$ film on the surface of said steel sheet, thereby said $SiO_2$ film providing a surface structure means on the surface of said steel sheet for said preventing said occurrence of denitriding during finish annealing;

finish annealing said steel sheet coated with said annealing separator thereby providing a steel sheet having a surface with glass film formation being absent on said surface.

5. A process for producing a grain oriented silicon steel sheet employing an aluminum nitride inhibitor comprising:

providing a steel material consisting essentially of, in terms of weight percent, 0.8 to 4.8% of Si, 0.012 to 0.05% of acid soluble Al, 0.01% or less of N, 0.02 to 0.3% of Mn, and 0.005 to 0.040% of S with the balance being essentially Fe and unavoidable impurities;

forming said steel material into a steel sheet, said steel sheet having a surface, including cold rolling said steel sheet one or more times, with intermediate annealing effected between cold rollings if there is more than one cold rolling;

after cold rolling, subjecting said steel sheet to decarburization annealing;

coating an annealing separator on the surface of said steel sheet wherein said annealing separator is at least one member selected from the group consisting of $Al_2O_3$, $SiO_2$, $ZrO_2$, BaO, CaO, SrO, and $MgSiO_4$, whereby said annealing separator is disposed between adjacent steel sheet surfaces during finish annealing;

preventing occurrence of denitriding of said steel sheet during finish annealing by maintaining an atmosphere during finish annealing prior to secondary recrystallization that is weakly oxidizing relative to Si wherein $pH_2O/pH_2$ is 0.01 to 0.1, thereby forming by external oxidation a $SiO_2$ film on the surface of said steel sheet, thereby said $SiO_2$ film providing a surface structure means on the surface of said steel sheet for said preventing said occurrence of denitriding during finish annealing;

finish annealing said steel sheet coated with said annealing separator thereby providing a steel sheet having a surface with glass film formation being absent on said surface.

6. A process for producing a grain oriented silicon steel sheet employing an aluminum nitride inhibitor comprising:

providing a steel material consisting essentially of, in terms of weight percent, 0.8 to 4.8% of Si, 0.012 to 0.05% of acid soluble Al, and 0.01% or less of N with the balance being essentially Fe and unavoidable impurities;

forming said steel material into a steel sheet, said steel sheet having a surface;

subjecting said steel sheet to decarburization annealing and then nitriding after decarburization annealing;

coating an annealing separator on the surface of said steel sheet wherein said annealing separator is at least one member selected from the group consisting of $Al_2O_3$, $SiO_2$, $ZrO_2$, BaO, CaO, SrO, and $MgSiO_4$, whereby said annealing separator is disposed between adjacent steel sheet surfaces during finish annealing;

preventing occurrence of denitriding of said steel sheet during finish annealing by enriching prior to secondary recrystallization during finish annealing a surface segregation element on the surface of said steel sheet, said surface segregation element being a member selected from the group consisting of Sn, Sb and Pb, thereby said surface segregation element providing a surface structure means on the surface of said steel sheet for said preventing of said occurrence of denitriding during finish annealing;

finish annealing said steel sheet coated with said annealing separator thereby providing a steel sheet having a surface with glass film formation being absent on said surface.

7. A process for producing a grain oriented silicon steel sheet employing an aluminum nitride inhibitor comprising:

providing a steel material consisting essentially of, in terms of weight percent, 0.8 to 4.8% of Si, 0.012 to 0.05% of acid soluble Al, 0.01% or less of N, 0.02 to 0.3% of Mn, and 0.005 to 0.040% of S with the balance being essentially Fe and unavoidable impurities;

forming said steel material into a steel sheet, said steel sheet having a surface, including cold rolling said steel sheet one or more times, with intermediate annealing effected between cold rollings if there is more than one cold rolling;

after cold rolling, subjecting said steel sheet to decarburization annealing;

coating an annealing separator on the surface of said steel sheet wherein said annealing separator is at least one member selected from the group consisting of $Al_2O_3$, $SiO_2$, $ZrO_2$, BaO, CaO, SrO, and $MgSiO_4$, whereby said annealing separator is disposed between adjacent steel sheet surfaces during finish annealing;

preventing occurrence of denitriding of said steel sheet during finish annealing by enriching prior to secondary recrystallization during finish annealing a surface segregation element on the surface of said steel sheet, said surface segregation element being a member selected from the group consisting of Sn, Sb and Pb, thereby said surface segregation element providing a surface structure means on the surface of said steel sheet for said preventing of said occurrence of denitriding during finish annealing;

finish annealing said steel sheet coated with said annealing separator thereby providing a steel sheet having a surface with glass film formation being absent on said surface.

8. A process according to claim 6 or 7 further comprising: coating a surface segregation element or a compound of a surface segregation element on the surface of the steel sheet prior to finish annealing.

9. A process according to claim 8 further comprising adding said surface segregation element or said compound of said surface segregation element to said annealing separator prior to coating said annealing separator on said surface of said steel sheet.

10. A process according to claim 6 or 7 wherein said surface segregation element is present in said steel material when said steel material is in a molten state prior to forming said steel sheet.

11. A process according to claim 1, 2, 4, 5, 6 or 7 further comprising removing an oxide layer formed during decarburization annealing from the surface of said steel sheet prior to finish annealing.

12. A process according to claim 11 or 2, 4, 5, 6 or 7 further comprising coating a powder of at least one member selected from the group consisting of $Al_2O_3$, $SiO_2$, $ZrO_2$, and $Mg_2SiO_4$ in slurry form on the surface of the steel sheet as the annealing separator, said powder having an average particle diameter of 0.5 to 10 μm.

13. A process according to claim 1, 4, or 6 wherein said steel material further consists essentially of 0.02 to 0.3% of Mn and 0.005 to 0.040% of S.

* * * * *

UNITED STATES PATENT AND TRADEMARK OFFICE

CERTIFICATE OF CORRECTION

PATENT NO. : 5,782,998

DATED : July 21, 1998

INVENTOR(S) : Yoshiyuki USHIGAMI, et al.

It is certified that error appears in the above-indentified patent and that said Letters Patent is hereby corrected as shown below:

Column 5, line 5, change "$pH_2O/pH_2$:" to --$H_2O/pH_2$:--.

Column 10, line 57, change "eight" to --weight--.

Column 20, line 57, change "11" to --1--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*